US008790229B2

(12) United States Patent
Font Lletche

(10) Patent No.: US 8,790,229 B2
(45) Date of Patent: Jul. 29, 2014

(54) METHOD AND MACHINE FOR THE CONTINUOUS MANUFACTURE OF PACKAGES MADE FROM FLEXIBLE MATERIAL AND RESULTING PACKAGE

(75) Inventor: Jordi Font Lletche, Santa Perpetua de Mogoda (ES)

(73) Assignee: Volpak, S.A.U., Santa Perpetua de Mogoda (ES)

( * ) Notice: Subject to any disclaimer, the term of this patent is extended or adjusted under 35 U.S.C. 154(b) by 258 days.

(21) Appl. No.: 13/388,950

(22) PCT Filed: Jul. 1, 2010

(86) PCT No.: PCT/ES2010/070452

§ 371 (c)(1),
(2), (4) Date: Apr. 20, 2012

(87) PCT Pub. No.: WO2011/015696

PCT Pub. Date: Feb. 10, 2011

(65) Prior Publication Data

US 2012/0195528 A1 Aug. 2, 2012

(30) Foreign Application Priority Data

Aug. 4, 2009 (ES) ..... 200901722

(51) Int. Cl.
*B31B 1/84* (2006.01)

(52) U.S. Cl.
USPC ..... 493/87; 493/213

(58) Field of Classification Search
USPC ..... 493/254, 87, 89, 84, 213
See application file for complete search history.

(56) References Cited

U.S. PATENT DOCUMENTS

| | | | | |
|---|---|---|---|---|
| 3,363,807 | A * | 1/1968 | Powell | 222/105 |
| 3,477,209 | A * | 11/1969 | Fesco | 55/367 |
| 6,053,401 | A * | 4/2000 | Andrews, Sr. | 229/117.3 |
| 6,062,431 | A * | 5/2000 | Geshay | 222/105 |
| 6,224,528 | B1 * | 5/2001 | Bell | 493/196 |
| 6,228,010 | B1 * | 5/2001 | Toriyama | 493/23 |

(Continued)

FOREIGN PATENT DOCUMENTS

| | | |
|---|---|---|
| DE | 90 06 774.4 U1 | 8/1990 |
| EP | 0 052 151 A1 | 5/1982 |

(Continued)

OTHER PUBLICATIONS

Spanish Search Report for ES 201030149, dated Oct. 28, 2011.

(Continued)

*Primary Examiner* — Sameh H. Tawfik
(74) *Attorney, Agent, or Firm* — Sughrue Mion, PLLC

(57) ABSTRACT

The invention relates to a method for continuously manufacturing containers made of a flexible material from a single continuous laminar band, or from several continuous laminar bands which will be longitudinally attached to form a single continuous laminar band, which will subsequently be transversely cut. In both cases, in a stage of the production phase a single laminar band, folded over itself along longitudinal fold lines, is obtained, the cross-section of which, open or closed according to the embodiment variant, forms a planar figure in which there is distinguished the upper base of the container, which in a variant of the method comprises a portion of band previously provided with holes and corresponding spouts, collapsed on one side, said single laminar band being susceptible of being driven by means of two drive rollers.

12 Claims, 11 Drawing Sheets

(56) References Cited

U.S. PATENT DOCUMENTS

| | | | | |
|---|---|---|---|---|
| 6,983,574 | B2 * | 1/2006 | Ausnit | 53/412 |
| 6,986,729 | B2 * | 1/2006 | Ichikawa et al. | 493/213 |
| 7,066,869 | B2 * | 6/2006 | Cook et al. | 493/69 |

FOREIGN PATENT DOCUMENTS

| | | | |
|---|---|---|---|
| ES | 2 292 311 | A1 | 3/2008 |
| WO | 96/19395 | A1 | 6/1996 |
| WO | 02/055402 | A2 | 7/2002 |
| WO | 2007/031330 | A1 | 3/2007 |
| WO | 2008/096392 | A1 | 8/2008 |

OTHER PUBLICATIONS

International Search Report of PCT/ES2010/070452 dated Nov. 3, 2010.

* cited by examiner

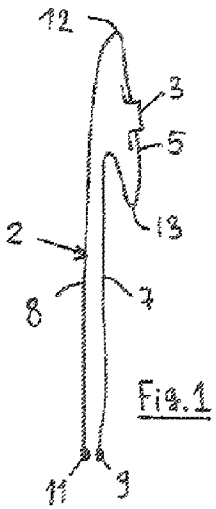
Fig.1
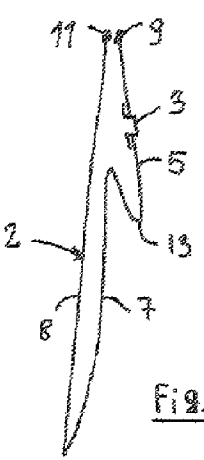
Fig.2
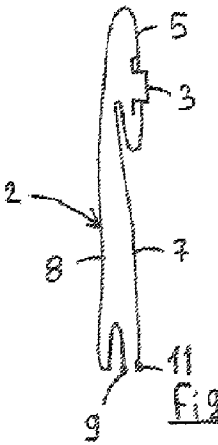
Fig.3
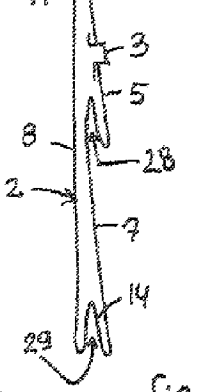
Fig.4
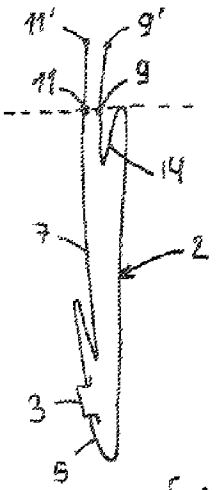
Fig.5
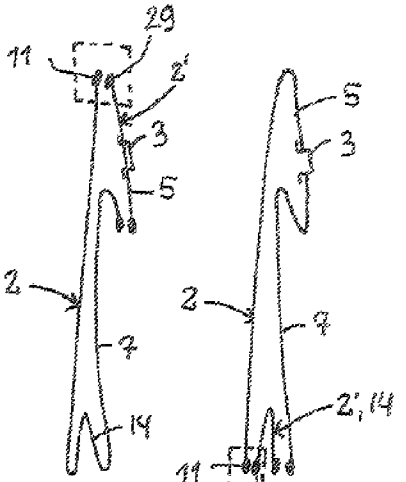
Fig.6
Fig.7

METHOD AND MACHINE FOR THE CONTINUOUS MANUFACTURE OF PACKAGES MADE FROM FLEXIBLE MATERIAL AND RESULTING PACKAGE

CROSS REFERENCE TO RELATED APPLICATIONS

This application is a National Stage of International Application No. PCT/ES2010/070452 filed Jul. 1, 2010, claiming priority based on Spanish Patent Application No. P200901722 filed Aug. 4, 2009 the contents of all of which are incorporated herein by reference in their entirety.

TECHNICAL FIELD OF THE INVENTION

The invention relates to a method for continuously manufacturing containers made of a flexible material, from single or several continuous laminar bands of plastic material heat-weldable on one of the faces thereof, the container being of the type in which there are distinguished, in the normal open position, two facing side walls and at least one upper base.

The invention also relates to a machine for putting the invention into practice and to a container obtained by means of the method.

BACKGROUND OF THE INVENTION

Patent documents EP0052151 and WO2007031330 describe similar containers, both made of a flexible material and in which there are distinguished, in the normal open position, two facing side walls and an upper base. The described containers furthermore comprise a lower base, similar in the two containers, formed by means of folding towards the interior of the container a portion of laminar band along a longitudinal fold line, which confers to the lower base an inverted "V" shape known in the art.

To date, providing the upper base of a container with these features of a rigid spout, which can be plugged by means of a cap or similar element, significantly altered the method and the machine necessary for continuously manufacturing the containers. This is so because in order to place the spouts in a central area of the upper base and fix it to the material forming said upper base it is necessary to individualize the container from the continuous laminar band or bands from which the containers are obtained, the end of the container being opposite the upper base that is still unclosed, for the purpose of being able to introduce in the container being manufactured, through its open lower base or bottom, the means necessary for performing the attachment by heat welding between the spout and the sheet portion. For this operation, at least a welding jaw and a welding counter-jaw are required, one of which acts from the exterior of the container and the other one of which acts from its interior, there being arranged between them, in a compressed manner, an essentially planar part of the spout and the portion of the upper base intended to be inseparably and tightly attached to the spout.

This way of operating is not applicable to any of the processes described in the aforementioned documents, in which the bottom of the container, and in this case the lower base, is always closed before individualizing the containers.

It is, therefore, a first objective of the invention to disclose an alternative method for continuously manufacturing and filling containers by means of which it is possible to obtain containers such as those described in WO2007031330, but also, without it being necessary for that purpose to significantly alter the means for putting it into practice, containers provided in their upper base with a spout suitable for extracting the contained product from the container.

It is another objective of the present invention that the method is suitable for obtaining the containers from a single initial laminar band if desired.

It is also an objective of the invention that the method allows obtaining containers the upper base of which lacks, at least along part of its contour of attachment with the side walls, heat-welded rims.

In addition, by means of the known processes for obtaining containers with an upper base, the sheet portion forming the mentioned upper base is folded over itself and towards the interior of the container, forming a portion folded in a general V shape the orthogonal edges of which are applied against the inner surface of the sheet portions forming the side walls, said edges being attached by means of respective triangular welds to said side walls which, furthermore, are also attached to one another. Thus, once the container is full, the upper base forms a cover with a general dome shape, having two opposite ends slightly sunken between the upper portions of the side walls of the container, which remain upright due to the effect of the aforementioned triangular welds and the attachment of the side walls, with orthogonal edges, along the entire length thereof.

These sunken ends of the upper base and the side walls which are raised on both sides of the container determine respective cavities in which dirt is housed during the periods of storage, transport and emptying of the containers.

Another objective of the present invention is that the method is suitable for obtaining an alternative container, obtainable from a single flexible sheet, which prevents the aforementioned drawback and at the same time improves the mechanical properties of the container once it is full and during the manoeuvres of opening the cap or closing the spout. In order to open the container, it is occasionally necessary to firmly hold the container while a turning movement is applied to the closure element or cap of the spout, especially when it is coupled to the body of the spout by screwing, and this turning movement can cause, by reaction, the container to have a tendency to be deformed by torsion around its vertical axis.

DISCLOSURE OF THE INVENTION

The method of the invention is suitable for continuously manufacturing containers made of a flexible material, of the type in which there are distinguished, in the normal open position, two facing side walls and at least one upper base.

The method is essentially characterized in that in a production phase, a single continuous laminar band is folded over itself along longitudinal fold lines until its cross-section forms a planar figure comprising the first side wall, along one of the edges of which the upper base of the container is collapsed, and the second side wall, the upper end portion of which is folded over itself downwardly and abuts the back of the collapsed upper base of the container, before the mentioned single laminar band is transversely cut.

In a variant of interest, the purpose of which is to manufacture a container provided with a spout in its upper base, in a first operation prior to the production phase there is applied on the single initial continuous laminar band, a series of spouts for allowing the exit of the product contained inside the containers to be manufactured, equidistant from one another and aligned according to a line parallel to the longitudinal edges of the corresponding band.

According to this variant of the invention, the base which is collapsed on one side of the first side wall is formed by the portion of laminar band on which the spouts have previously been applied.

According to an embodiment of this variant of interest, before the application of the spouts, the portion of laminar band on which the spouts are applied is provided with a series of holes for communicating the interior of the container to be manufactured with the exterior through the corresponding spouts. This embodiment is intended for manufacturing containers in which the closure of the spout lacks means for perforating the sheet forming the upper base. In other words, for containers in which the spout will be closed by conventional closure means such as a screw cap or the like.

A variant of the invention initially starts from a single continuous laminar band which in the first prior operation is provided with the alignment of holes and/or corresponding spouts, the portion of material separating the spouts from each of the longitudinal opposite edges of the laminar band being sufficient to form in the subsequent production phase half of the upper base and a respective side wall.

According to a mode of carrying out this embodiment variant, the alignment of spouts is not equidistant from the longitudinal edges of the single initial laminar band.

According to this embodiment variant, the alignment of spouts is shifted towards one of the longitudinal edges of the single initial laminar band, and the portion of material separating the spouts from one of the longitudinal edges of the mentioned laminar band is sufficient to form in the subsequent production phase half of the upper base, a corresponding side wall and the lower base of the container.

According to a variant of the method according to the invention, the containers are produced in an inverted position.

According to a preferred variant of the previous embodiment, the portions resulting from the four welding attachments of the two pairs of corners of the upper base with the side walls are subjected to an additional cutting, adhesion, folding or conditioning operation.

Preferably, in that variant in which the four welding attachments of the two pairs of corners of the upper base with the side walls have a triangular shape, said attachments are subjected to a cutting operation in the direction of the hypotenuse, providing the upper base of the container being produced and the respective side walls with corresponding bevels.

Another object of protection is a container obtainable by means of the claimed method, the one formed by one sheet made of a flexible material heat-weldable on one of the faces thereof being especially advantageous. which container comprises an upper base with a general parallelepiped shape with its edges being bevelled and without any fold line traversing it transversely or longitudinally, preferably provided with a spout through which the content of the container can be poured to the exterior, and two side walls with their upper edges bevelled in correspondence with the bevels of the mentioned upper base, each bevel of the upper base being attached by heat welding to the bevelled edge of a corresponding side wall, a pair of inclined weld beads being formed on each side of the container, which determine respective transition shoulders between the central portion of the upper base and the sides of the container, the inclined weld beads of one and the same pair converging in a corresponding vertical weld bead of attachment between the facing edges of the two side walls of the container, which extends to the bottom, or lower base, of the mentioned container.

According to a variant of this advantageous container, at least one of the side walls is provided with an upper extension, extending above the level of the upper base of the container, and one of the sides of the mentioned upper base is formed by a fold line along which the sheet portion forming it is folded upwardly to form a flap, said flap being juxtaposed to the upper extension of the side wall and tightly attached thereto at its contour to form a side neck of the container.

In an especially advantageous embodiment for liquid products, the spout is arranged in the area of the upper base which determines one of the transition shoulders.

According to an embodiment variant of the container according to the invention, the sheet portions forming the upper base and at least one of the side walls of the container are two contiguous portions of one and the same sheet attached without interruption, the sheet portion forming the upper base being provided with a vertical rim applied and attached by heat welding to the upper edge of said vertical wall.

According to another aspect of the invention, a machine for putting the method object of protection into practice is disclosed. Said machine is essentially characterized by comprising, in the advance direction of the band or bands, —a device suitable for making an alignment of holes in a continuous laminar band and for placing a corresponding spout in each of them; means for folding over itself a single initial laminar band, or a single laminar band formed from the longitudinal attachment of two or more initial continuous laminar bands, until its cross-section forms a planar figure comprising a first side wall along one of the edges of which there is collapsed a longitudinal strip of the laminar band comprising the portion of band previously provided with spouts, and a first side wall, the upper end part of which is folded over itself downwardly and abuts the back of the mentioned longitudinal strip of the laminar band; transverse cutting means for the folded single laminar band to separate a container being manufactured from the rest of the folded laminar band; and means for turning the mentioned longitudinal strip of the separated container with respect to the side walls until the cross-section of the container being manufactured adopts a contour with a general "T" shape.

BRIEF DESCRIPTION OF THE DRAWINGS

FIGS. 1 and 2 are respective section views of a single initial laminar band, corresponding to a specific stage of the production phase prior to the transverse cut, according to two different variants of a method for the manufacture of a container without a lower base;

FIGS. 3, 4 and 5 are respective section views of a single initial laminar band, corresponding to a specific stage of the production phase prior to the transverse cut, according to three different variants of the method of the invention for the manufacture of a container with a lower base;

FIGS. 6 and 7 are respective section views of two initial continuous laminar bands, immediately before forming a single laminar band, in a specific stage of the production phase prior to the transverse cut, according to two different variants of a method for the manufacture of a container with a lower base;

FIG. 14 is a perspective view of a machine for putting into practice the method according to the variant depicted in FIG. 5;

DETAILED DESCRIPTION OF THE INVENTION

Figure 11:
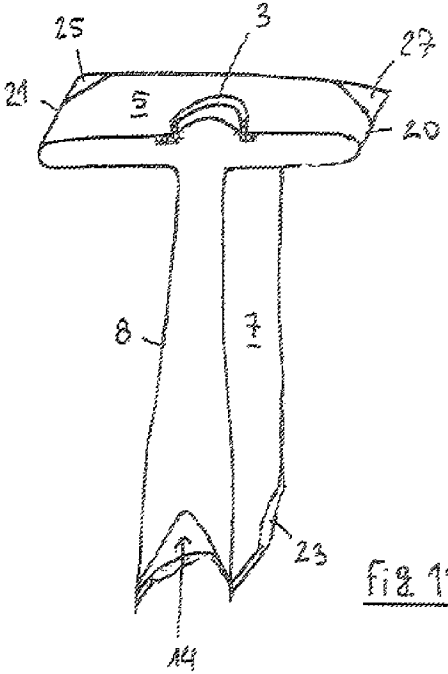
FIGS. 8, 9, 10 and 11 are a sequence of the operations which are carried out on a single initial laminar band according to a preferred embodiment variant of the method according to the invention.

The method according to the invention is suitable for the manufacture of containers from a single continuous laminar band, or from several continuous laminar bands which will be longitudinally attached to form a single continuous laminar band, which will subsequently be transversely cut. In both cases, in a stage of the production phase a single laminar band, folded over itself along longitudinal fold lines, is obtained, the cross-section of which, open or closed according to the embodiment variant, forms a planar figure in which there is distinguished the upper base of the container collapsed on one side, said single laminar band being susceptible of being driven by means of two drive rollers. As detailed below, if containers provided with a respective spout in their upper bases are to be obtained, the portion of band forming the mentioned collapsed base is previously provided with an alignment of spouts (and corresponding holes if necessary), without this altering the manner in which the single laminar band is handled in the production phase, the method allowing the manufacture of containers with or without a spout in their upper base.

FIGS. 1 to 5 depict different variants of a mode of carrying out the method in which the containers are manufactured from a single continuous laminar band 2 in which, in a first prior operation, a series of holes has been precisely made, in which holes respective spouts 3 are placed.

Among the depicted variants, FIGS. 1 and 2 show the contour of the cross-section of the laminar band 2 in a stage of the production phase, prior to the transverse cut of the laminar band 2, suitable for obtaining a container 1 (see FIG. 16) with a single upper base 5, at the bottom of which the first and second side walls 8 and 7, respectively, are attached forming a V-shaped container bottom similar to that of a common tube of toothpaste.

In both cases, the cross-section is originally open and in the variant of FIG. 1 the longitudinal edges 9 and 11 of the laminar band 2 will be attached by heat welding, preferably before transversely cutting the laminar band 2, to form the bottom of the container 1, whereas in the variant of FIG. 2 the longitudinal edges 9 and 11 of the laminar band 2 will be attached, also by heat welding and preferably before transversely cutting the laminar band 2, along the edge of attachment between the upper base 5 and the first side wall 8 of the container 1.

In the variant of FIG. 1, the upper base 5 is determined by two longitudinal folds 12 and 13 made in the laminar band 2, whereas in the variant of FIG. 2, the upper base 5 is determined by the weld bead of attachment between the longitudinal edges 9 and 11 of said laminar band 2 and the single longitudinal fold 13.

As has been mentioned above, in both variants, the attachment by heat welding between the longitudinal edges 9 and 11 of the laminar band 2 is preferably performed before transversely cutting the laminar band 2, the cross-section of the laminar band 2 will therefore have a closed contour when the cut is made.

Unlike the variants of FIGS. 1 and 2, the variants depicted in FIGS. 3 to 5 show respective cross-sections of a continuous laminar band 2 folded over itself along longitudinal fold lines, suitable for obtaining a container 10 (see FIGS. 17*a* and 17*b*) with an upper base 5 and with a lower base 14, the latter being similar to that of a doy-pack type container, known in the art.

It is seen in the variant of FIG. 3 that the upper base 5 is attached without interruption with the portions of laminar band 2 forming the first and the second side walls 8 and 7, whereby the container 10 finally obtained will lack attachment seams, or heat welding strips, in its upper base 5 along its front and rear attachment with the mentioned side walls 7 and 8.

Figure 12:
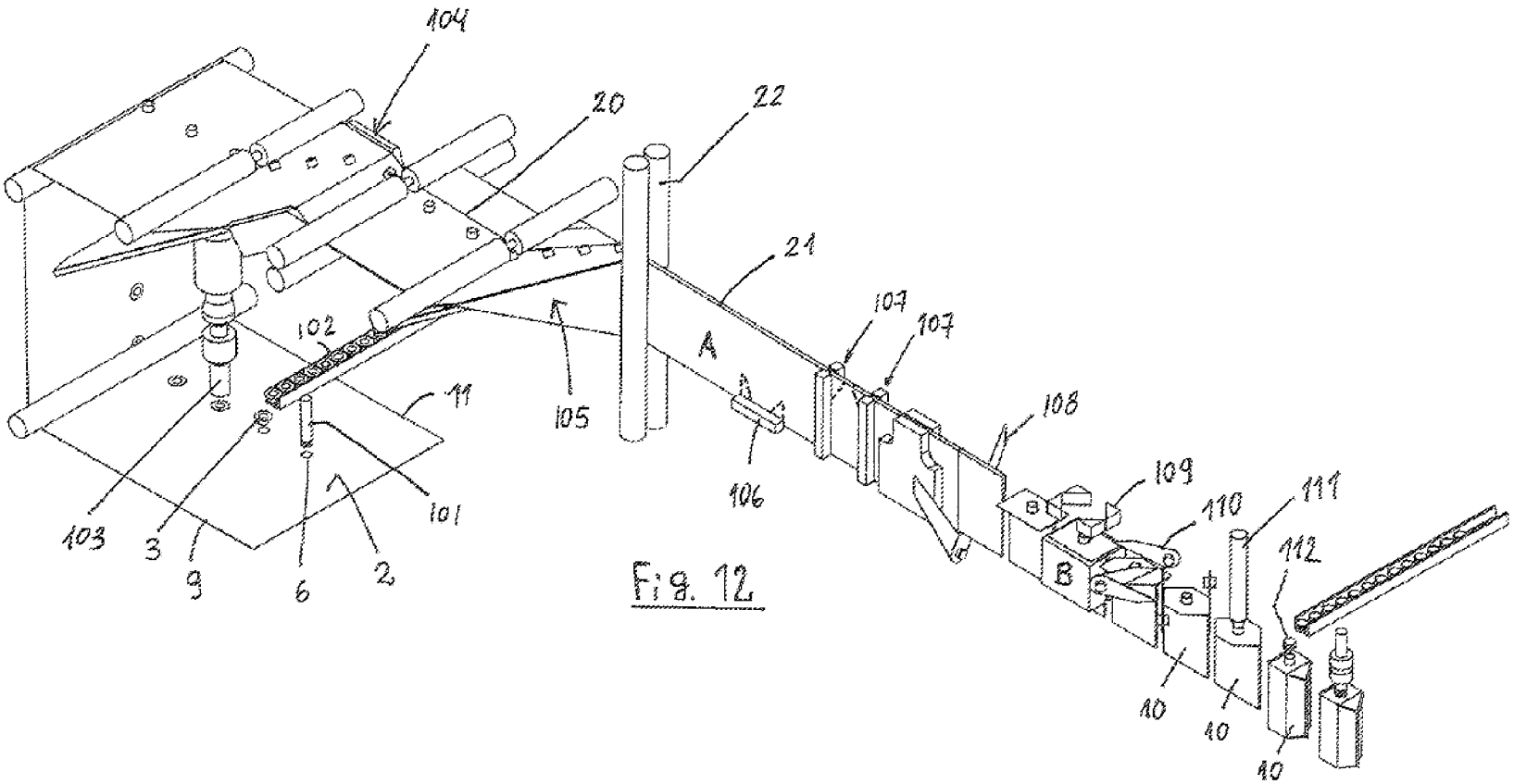
FIG. 12 is a perspective view of a machine for putting into practice the method according to the variant depicted in FIGS. 8 to 11.

FIGS. 8 to 11 depict a sequence of operations of the production phase of the method for manufacturing the container 10 described above and depicted in FIGS. 17*a* and 17*b*, whereas FIG. 12 depicts a machine 100 for putting it into practice. Then, the method for the manufacture of the container 10 will be described in detail making reference, when necessary, to FIGS. 8 to 11 and alternately to FIG. 12, which shows the machine 100.

In a first prior operation, the continuous laminar band 2 is provided with series of holes 6, which are identical and equidistant from one another, aligned according to a line parallel to the longitudinal edges 9 and 11 of the band, a corresponding spout 3 for allowing the exit of the product contained inside the container 10 being placed in each hole, all this as illustrated in FIG. 12, which shows the machine 100 provided with a punch 101; with spout dispensing means 102; and with attachment means 103 for attaching the spouts 3 in the laminar band 2.

Figure 8:
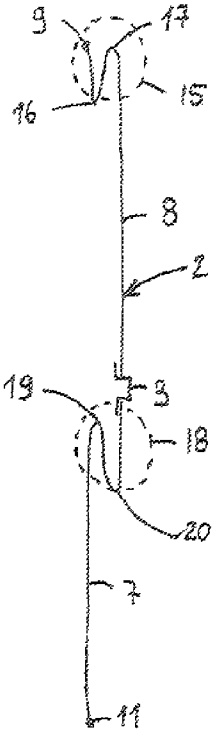

It is seen in this FIG. 12 and also in FIG. 8 that the alignment of holes 6 is shifted towards one of the longitudinal edges of the continuous initial laminar band 2, and specifically towards its longitudinal edge 11.

Figure 10:
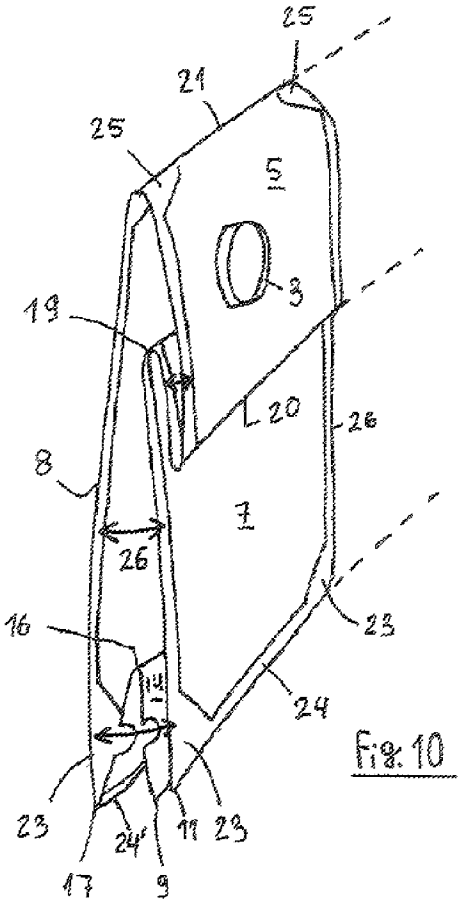
Figure 9:
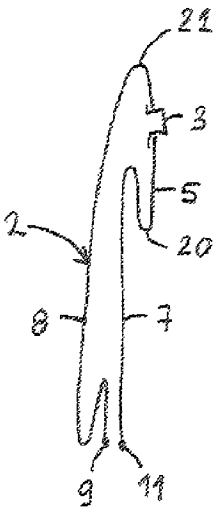

Then, the production phase is started, in which the operations of folding the laminar band 2 according to a first double zigzag fold 15, towards its heat-weldable face, over a first and a second longitudinal fold line 16 and 17, with alternate 180° angles, to form the lower base of the container; and of folding the laminar band 2 according to a second double zigzag fold 18, also towards its heat-weldable face and with alternate 180° angles, over a third and a fourth longitudinal fold line 19 and 20, the second side wall 7 of the container being determined between the fourth fold line 20 and the closest longitudinal edge 11 of the laminar band 2, all this as illustrated below in FIGS. 8 to 10.

Next, as illustrated in FIG. 9, the laminar band 2 is folded over itself according to a third 180° fold towards its heat-weldable face, over a fifth longitudinal fold line 21, the fourth and the fifth fold lines 20 and 21, which delimit the upper base 5 of the container, each being on one side of the alignment of spouts 3, such that the inner face of the second longitudinal edge 11 of the laminar band 2 is superimposed and coincident with the inner face of the first longitudinal edge 9 of the laminar band, the first side wall 8 of the container being determined between the fifth fold line 21 and the second fold line 17.

The machine 100 has for that purpose (see FIG. 12) a first and a second folding device 104 and 105, the first one being suitable for simultaneously making the first and second zigzag folds 15 and 18 before the laminar band 2 is folded along the fifth longitudinal fold line 21 by the mediation of the second folding device 105.

The obtained form is flattened by a set of folding rollers 22 and is forced to advance towards the heat welding stations, depicted in FIG. 12. In these stations, the corners of the lower base are attached by welding to the respective facing areas 23 of the first and second side walls 8 and 7; the facing longitudinal edges 9 and 11 of the laminar band 2 along a longitudinal strip 24 and the facing portions of the laminar band 2 along another longitudinal strip 24' coincident with the second fold line 17; the first and second side walls 8 and 7 along two transverse weld beads 26 separated according to the width of an empty and folded container; and the corners of the upper base 25 with the portions of laminar band 2 of the first side wall 8 which abut the back of the mentioned upper base 5, all this as shown in FIG. 10. The moment in which the laminar band adopts the form depicted in FIG. 9 has been indicated by means of the letter A in FIG. 12.

Generally, the two faces of the laminar bands used for the manufacture of containers similar to that of the invention are provided with different properties since the face intended to be the outer face of the container will server as support for printing data or advertising, while the inner face will be in direct contact with the product stored by the container. Due to said properties, it is difficult to attach by welding facing portions of the face of the laminar band intended to be exposed to the exterior. To avoid this drawback, before the production phase the initial laminar band, or the laminar band from which the bottom of the container is formed, is subjected to another perforation operation, different from the previous one, in which groups of holes are made, not depicted in FIGS. 12 to 15 since they are known, which are formed by two pairs of holes made in the portion of laminar band which will form the lower base 14 of the container, the holes of one and the same pair being separated such that each will be located on one side of the first fold line 16, each pair of holes being separated from one another by a distance equivalent to the first and second side walls 8 and 7 along the transverse weld beads 26. Said holes allow also carrying out, without any problem, the attachment of the side walls 7 and 8 in the areas of the corners of the lower base 23 in which the portion of laminar band 2 forming the lower base 14 of the container is interposed. The holes allow the contact between the inner faces of the side walls 7 and 8, susceptible of being attached by welding, as indicated by the arrow of FIG. 10.

In relation to the machine depicted in FIG. 12, despite the fact that the corners of the lower base 14 can be attached to the respective facing areas 23 of the first and second side walls 8 and 7 by means of the same set of lower welding jaws 106 used to attach the facing longitudinal edges 9 and 11 of the laminar band 2, and that the attachment of the corners of the upper base 25 with the portions of laminar band 2 of the first side wall 8 can be performed by means of the same set of transverse welding jaws 107, in the depicted variant these operations can be carried out in a subsequent station, once the transverse cut of the continuous laminar band 2 by the cutting means 108 has taken place, as will be described below.

Performing the welding of the two pairs of corners of the upper base 25 and 27 with the side walls 8 and 7, respectively, before transversely cutting the laminar band, an operation which is described below, is also contemplated.

Once the attachments described above have been performed, the laminar band 2 is transversely cut by means of a cut made substantially through the middle of the transverse weld beads 26, individualizing at least one container from the rest of the continuous laminar band 2 and the container portion comprised between the mentioned fourth and fifth fold lines 20 and 21, which determines its upper base 5, is turned, the fourth fold line 20 of the second side wall 7 of the container being separated until adopting a position substantially perpendicular to the body of the container 10, depicted in a section view in FIG. 11, for the transport of the container suspended from the spout 3. Once this position has been reached, the corners of the upper base 27 (only one of which is visible in FIG. 11) are attached by welding with the portions of laminar band 2 of the second side wall 7 which now abut the underside of the mentioned upper base 5.

In the machine 100 depicted in FIG. 12, the attachment of the corners of the upper base 27 is performed simultaneously and by means of the same set of closing jaws 109. The moment in which the container adopts the form depicted in a section view in FIG. 11 has been indicated by means of the letter B in the same FIG. 12.

Optionally, the cantilevered portions resulting from the four welding attachments of the two pairs of corners of the upper base 25 and 27 with the side walls 8 and 7, respectively, are subsequently subjected to an additional cutting, adhesion, folding or conditioning operation, depicted in FIG. 12 by means of the group of shears 110. If the container is subjected to the cutting operation, it will have, once it is full, considerable technical advantages in practice as will be described below.

Another way of operating consists of cutting the pair of corners of the upper base 25 with the side wall 8 before transversely cutting the laminar band 2, a cutting die being used, and leaving for later on, when the container being manufactured adopts the position of FIG. 11, the cut of the corners of the upper base 27 with the shears.

The container 10 is then completed and ready to be filled through the spout 3 by means of conventional filling means 111, which will subsequently be closed with a corresponding closure cap 112.

For the purpose of producing symmetrical containers 10, it can be seen that the first double zigzag fold 15 is made such that the distance separating a first longitudinal edge 9 of the laminar band 2 from the first fold line 16 is equal to that separating the latter from the second fold line 17, making said first longitudinal edge of the laminar band be superimposed and coincident with said second fold line 17. Likewise, the second double zigzag fold 18 is made such that the distance between said third and fourth fold lines 19 and 20 is substantially equal to that between the first and second fold lines 16 and 17. Likewise, the distance between the fourth and the fifth fold lines 20 and 21 is twice the one between the first and the second fold lines 16 and 17, the spouts 3 being arranged in the geometric centre of the quadrangular area forming the upper base 5 of the container 10 being formed.

Figure 17A:
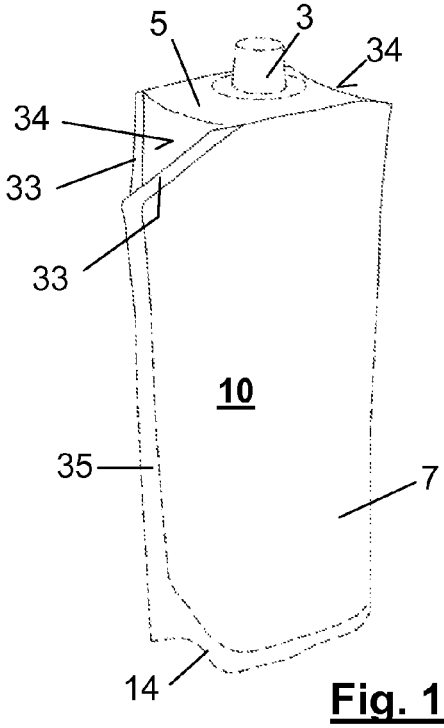
FIGS. 17*a* and 17*b* show a container obtainable by means of the variant of the method depicted in FIG. 3; or 5
Figure 17B:
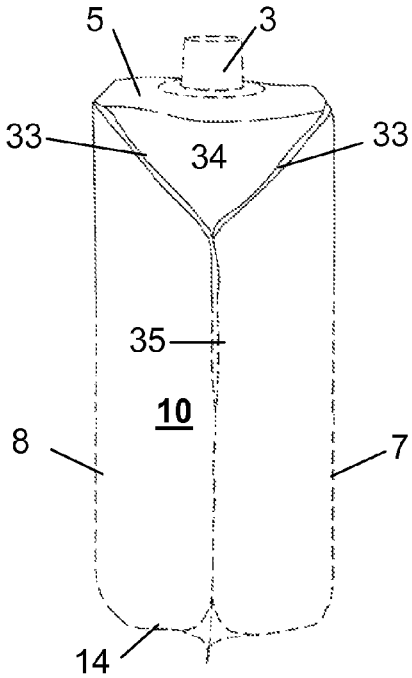

FIGS. 17*a* and 17*b* depict the container 10 finally obtained, formed by a single initial laminar band, in which there are distinguished the upper base 5, with a general parallelepiped shape, and the two side walls 7 and 8 attached along respective vertical weld beads 35, the result of cutting the laminar band through the transverse weld beads 26 in the transverse cutting operation.

It is observed that when the four welding attachments of the two pairs of corners of the upper base 2 with the side walls 7 and 8 are subjected to the mentioned cutting operation by means of the group of shears 110, the result is a container 10 in which both the edges of the upper base 5 and the upper corners of the side walls 7 and 8 have respective bevels 31 and 32.

Once the containers are filled, this cutting operation causes the container 10 to have a pair of inclined weld beads 33 on each side of the container 10, which determine respective transition shoulders 34 (only one of which is seen in FIGS. 17*a* and 17*b*) between the central portion of the upper base 5 and the sides of the container 10, the two inclined weld beads of one and the same pair converging in the corresponding vertical weld bead 35 of attachment between the facing edges of the two side walls 7 and 8 of the container 10, which extends to the bottom of the mentioned container, formed in this case by a lower base 14. It can be seen that this feature is common to all the variants depicted in FIGS. 19 to 24.

In addition to the fact that the cutting operation leaves the transition shoulders 34 more accessible, which allows placing the spout 3 in this area (see FIGS. 22 and 23), the accumulation of dirt is prevented and the rigidity of the container 10 is reinforced. Indeed, the inclined welds 33 provide the container 10 with higher torsional strength in comparison with the containers in which the cutting operation is not performed, such that the side walls are raised around the transition shoulders 34 attached along the vertical weld beads, which extend until the highest portion of the upper base 5 of the container.

Figure 13:
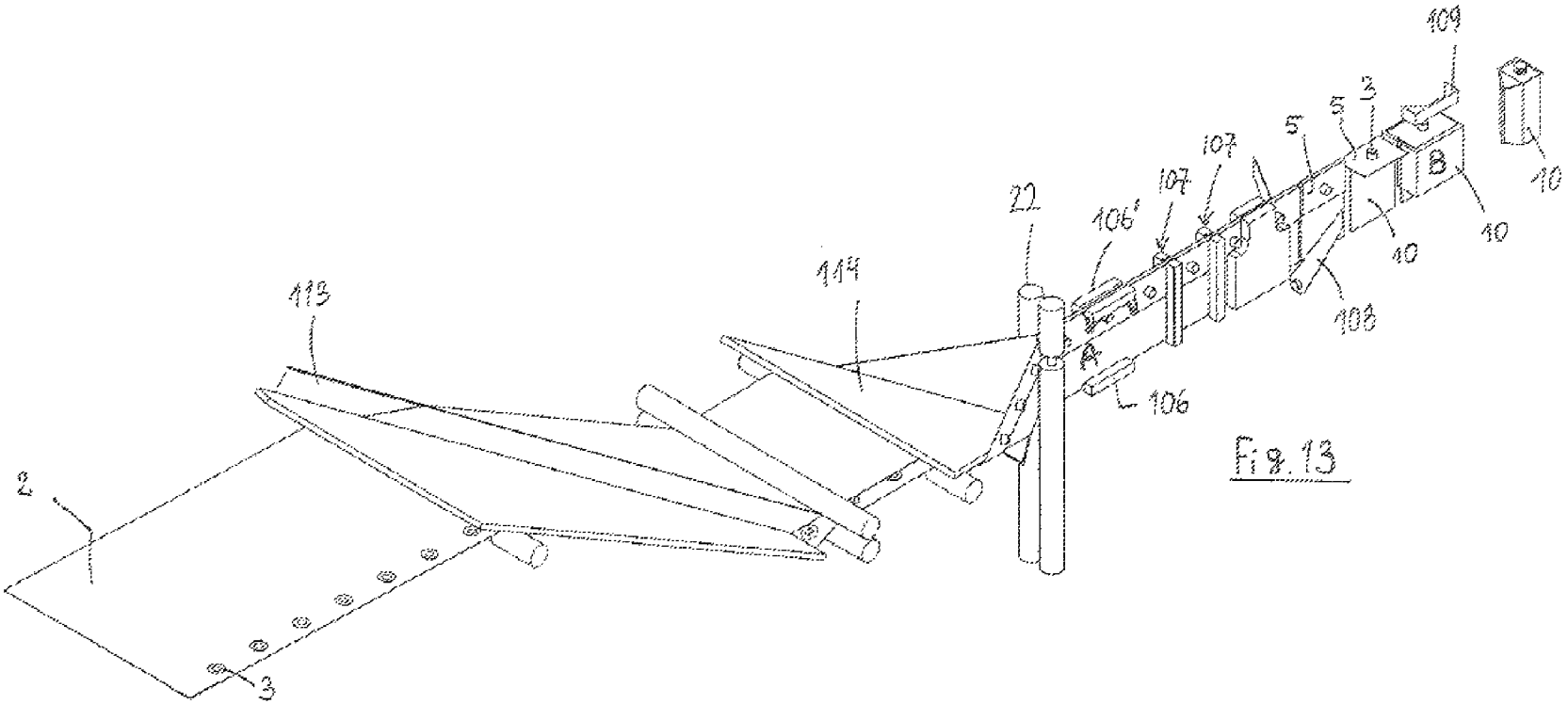
FIG. 13 is a perspective view of a machine for putting into practice the method according to the variant depicted in FIG. 4.
Figure 11:
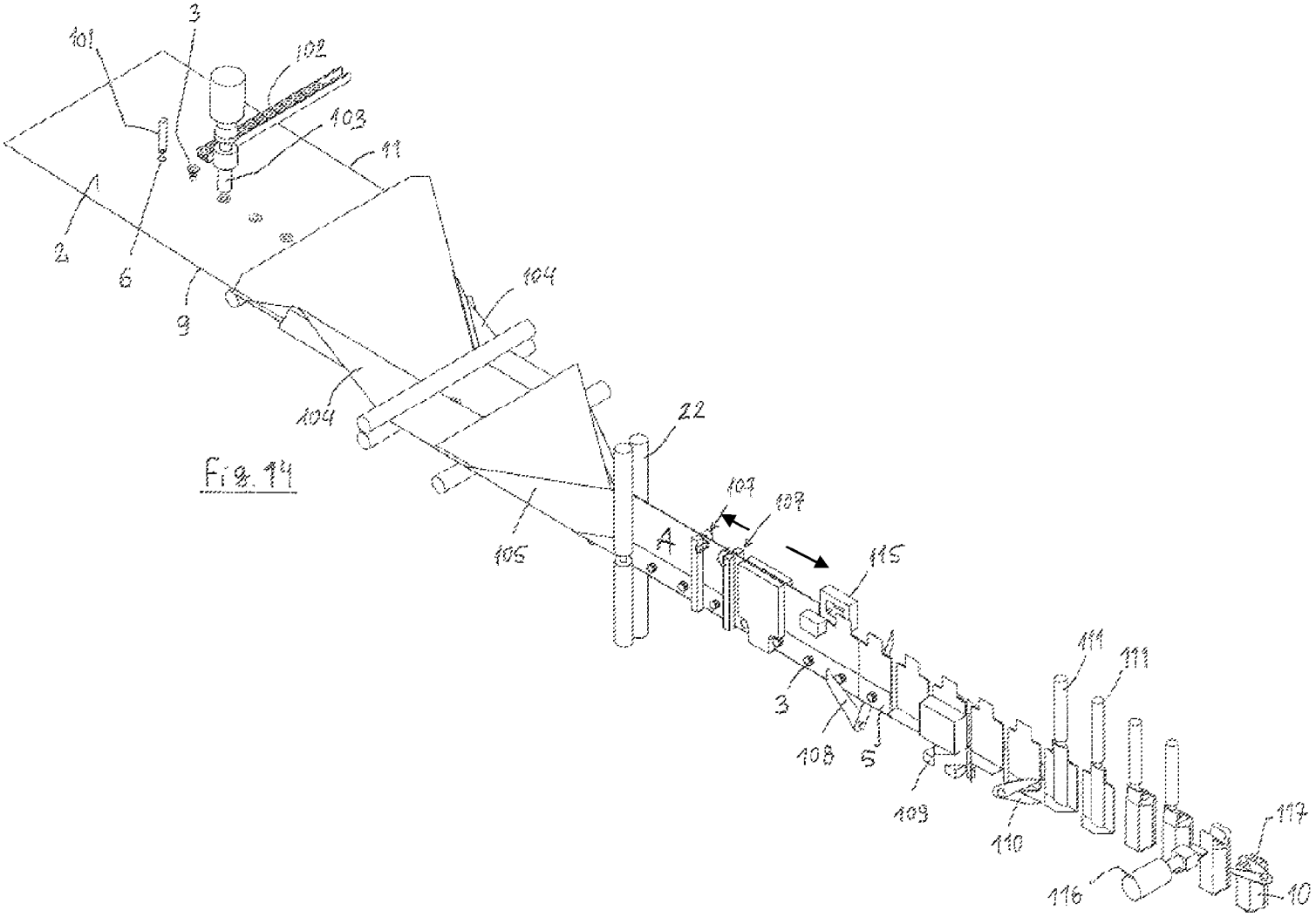

FIG. 13 depicts a variant of the machine 100 according to the invention, suitable for folding over itself a single initial laminar band 2 and reaching a form the cross-section of which has been depicted in FIG. 4. In this figure, the same reference numbers have been used to designate components equivalent to those of the machine 100 depicted in FIG. 12.

In the variant of FIG. 4, it is observed that the longitudinal edges 9 and 11 of the laminar band 2 are attached, also by heat welding and preferably before transversely cutting the laminar band 2, along the edge of attachment between the upper base 5 and the first side wall 8 of the container being manufactured. It is observed that in this case the alignment of spouts 3 will be considerably shifted towards the longitudinal edge 9 of the laminar band 2.

The machine 100 of FIG. 13, in which the means for making the alignment of holes and subsequent placement of the spouts have not been depicted, is provided with a first folding device 113, suitable for causing a first double zigzag fold 28 (see FIG. 4), and with a second folding device 114, suitable for folding the sheet according to a triple fold 29 to produce the lower base of the container. The moment in which the laminar band 2 flattened by the folding rollers 22 adopts the position depicted in FIG. 4 has been highlighted with the letter A in FIG. 13.

The laminar band 2 is forced to advance towards the heat welding stations, in which by means of a set of lower welding jaws 106 the corners of the lower base 14 are attached by welding to the respective facing areas of the first and second side walls 8 and 7 and the facing portions of the laminar band 2 along longitudinal strips coincident with the end fold lines of the triple fold 29; by means of a set of upper welding jaws 106' the facing longitudinal edges 9 and 11 of the laminar band 2 are attached by welding; and by means of a set of transverse welding jaws 107 the first and second side walls 8 and 7 are attached along two transverse weld beads separated according to the width of an empty and folded container.

The laminar band 2 then becomes a tubular band, which is transversely cut by the cutting means 108 to individualize the container or containers being manufactured.

Then, in a manner similar to the method which is carried out in the machine 100 of FIG. 12, the upper base 5 of the container 10 is turned until it adopts a position substantially perpendicular to the body of the container 10 for the transport of the container suspended from the spout 3. Once this position has been reached, the pair of corners of the upper base 5 are attached by welding with the portions of band forming the second side wall 7 which now abut the underside of the mentioned upper base 5. This operation is performed by the group of upper closing jaws 109.

Unlike the machine 100 of FIG. 12, it is observed in this variant of FIG. 13 that the attachment of the corners of the upper base 5 with the portions of the laminar band 2 forming the first wall 8 is performed in prior step by means of the upper welding jaws 106', whereby the group of upper closing jaws 109 actually only attaches the pair of corners of the upper base 5 abutting the second side wall 7.

It is pointed out that in FIG. 13 the letter A indicates the moment in which the laminar band 2 adopts the form depicted in FIG. 4; and the letter B indicates the moment in which the container 10 being manufactured adopts a form similar but not identical to that of FIG. 11, since in this case there is a weld bead of attachment along one of the sides of the upper base 5 and the first side wall 8, i.e., along the attachment between the longitudinal edges 9 and 11 of the laminar band 2.

FIG. 14 depicts an interesting variant of the machine 100 according to the invention, suitable for folding over itself a single initial laminar band 2 and reaching a form the cross-section of which has been depicted in FIG. 5. In this figure, the same reference numbers have been used to designate components equivalent to those of the machine 100 depicted in FIG. 12.

In the variant of FIG. 5, it is first observed that the container is produced in an inverted position and that the longitudinal edges 9 and 11 of the laminar band 2 face one another in the upper part of the figure formed when the laminar band 2 is folded along longitudinal fold lines.

Unlike the previous variants, the contour of the cross-section is open when the continuous laminar band 2 is transversely cut by the cutting means 108, so that the container can be filled through the opening formed in its lower base 14, which is arranged in the upper part since the container 10 is produced in an inverted position. The moment in which the continuous laminar band 2 adopts the form depicted in FIG. 5 has been indicated with the letter A in FIG. 14.

With the laminar band 2 adopting this position, as in the variants in which the container is not produced in an inverted position, the welding attachments of the two pairs of corners of the upper base 25 and 27 with the side walls 8 and 7 can be carried out, as well as the cut of the corners of the upper base 25 with the corresponding side wall 8 simultaneously with the transverse cut of the laminar band 2, leaving the cut of the pair of corners of the upper base 27 for later on.

The operations followed are well known in the state of the art and it must only be observed that, unlike the previous variants, there is a loss of material since the laminar band 2 is extended beyond the longitudinal strips 9 and 11, which will be attached by heat welding in the welding station 116, until the longitudinal edges 9' and 11' (see FIG. 5), the excess laminar band 2 being cut once the container 20 is closed, at the level of said longitudinal strips, in the last cutting station 117. The sequence of operations for filling and closing the opening of the container 10, as well as the means for putting it into practice, once the laminar band adopts the form A indicated in FIG. 14, are described, for example, in patent document ES 2292311.

This variant allows, for example, the manufacture of containers in which the portion of laminar band 2 on which the spouts 3 are applied is not perforated (variant not depicted). In this type of containers, when the cap or closure element plugging the spout 3 is manipulated to open the full container, the laminar band is perforated. To that end, the cap for the mobile parts of the closure system is provided with cutting means for the laminar band.

In relation to the variants of FIGS. 6 and 7, they correspond to embodiments in which the container 10 is obtained from two continuous laminar bands 2 and 2'.

In the first case, the laminar band 2', previously perforated and with the spouts 3 placed in the corresponding holes, will integrally form the upper base 5 and will abut the laminar band 2, previously folded along longitudinal fold lines, as indicated in FIG. 6. Preferably, a single laminar band is formed by means of the attachment by heat welding of the longitudinal edges 11 and 29 of the laminar bands 2 and 2', respectively, which is subsequently transversely cut.

In the second case, the continuous laminar band 2' will form the lower base 14 of the container, and a single laminar band will also be formed by means of the attachment by heat welding of the longitudinal edges 11 and 29 of the laminar bands 2 and 2', respectively, which will subsequently be transversely cut.

Figure 15:
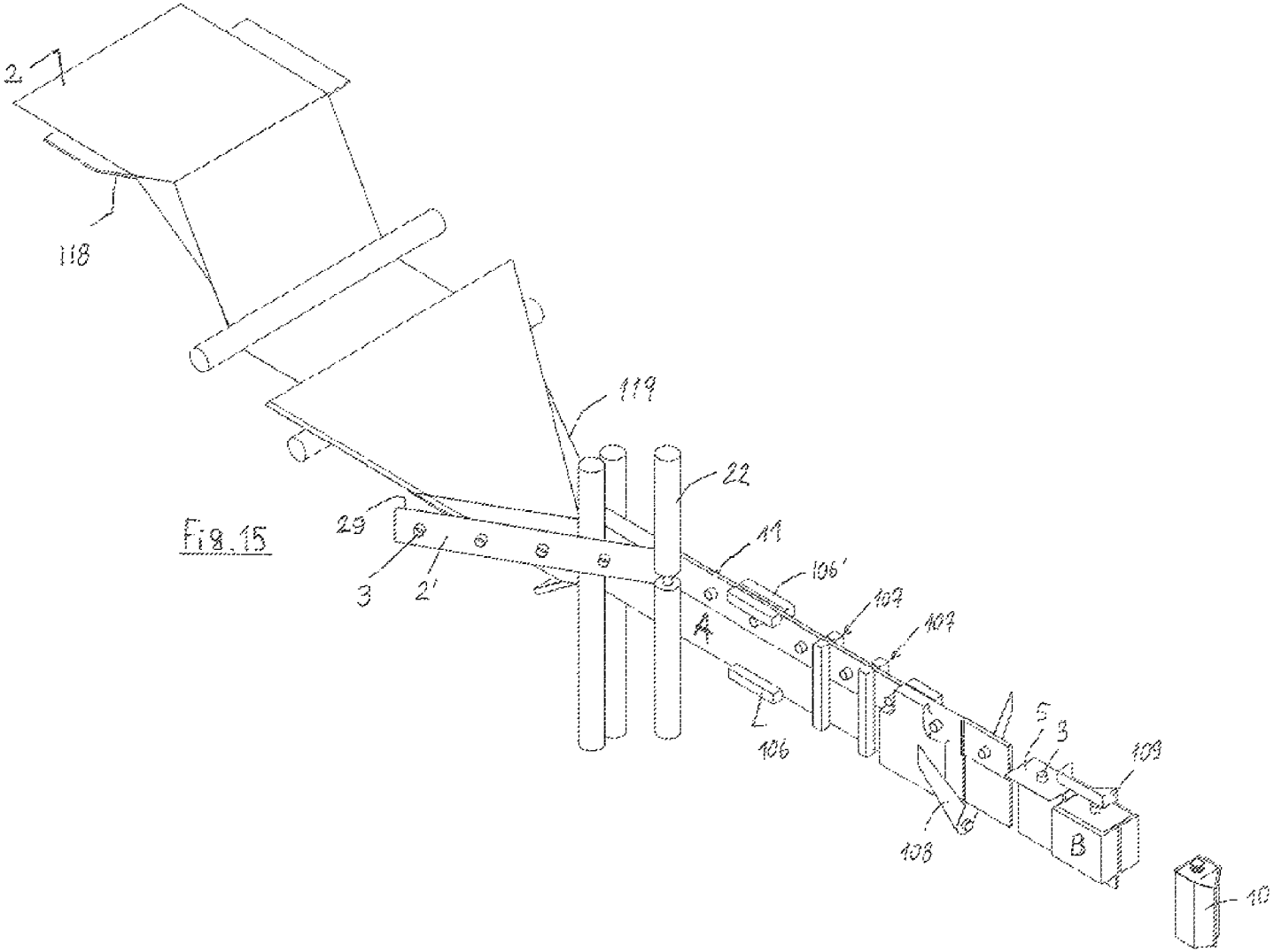
FIG. 15 is a perspective view of a machine for putting into practice the method according to the variant depicted in FIG. 6.

FIG. 15 depicts a machine for putting into practice the variant of the method depicted in FIG. 6. According to this embodiment variant, the machine 100 comprises a first folding device 118 for the laminar band 2, to cause a simple fold in the laminar band 2 adjacent to the longitudinal edge opposite its longitudinal edge 11, and a second folding device 119, for causing a triple fold similar to the triple fold 20 of the variant depicted in FIG. 4. The moment in which the laminar bands 2 and 2' are arranged according to FIG. 6 has been indicated with the letter A in FIG. 15.

It can be observed that downstream from this point, the machine 100 of FIG. 15 is similar to the machine depicted in FIG. 13.

Figure 16:
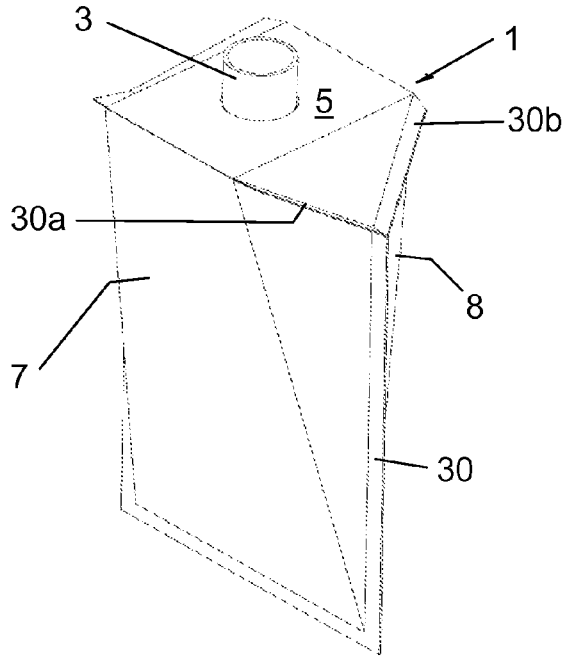
FIG. 16 is a perspective view of a container obtainable by means of the method depicted in FIG. 1.
Figure 18:
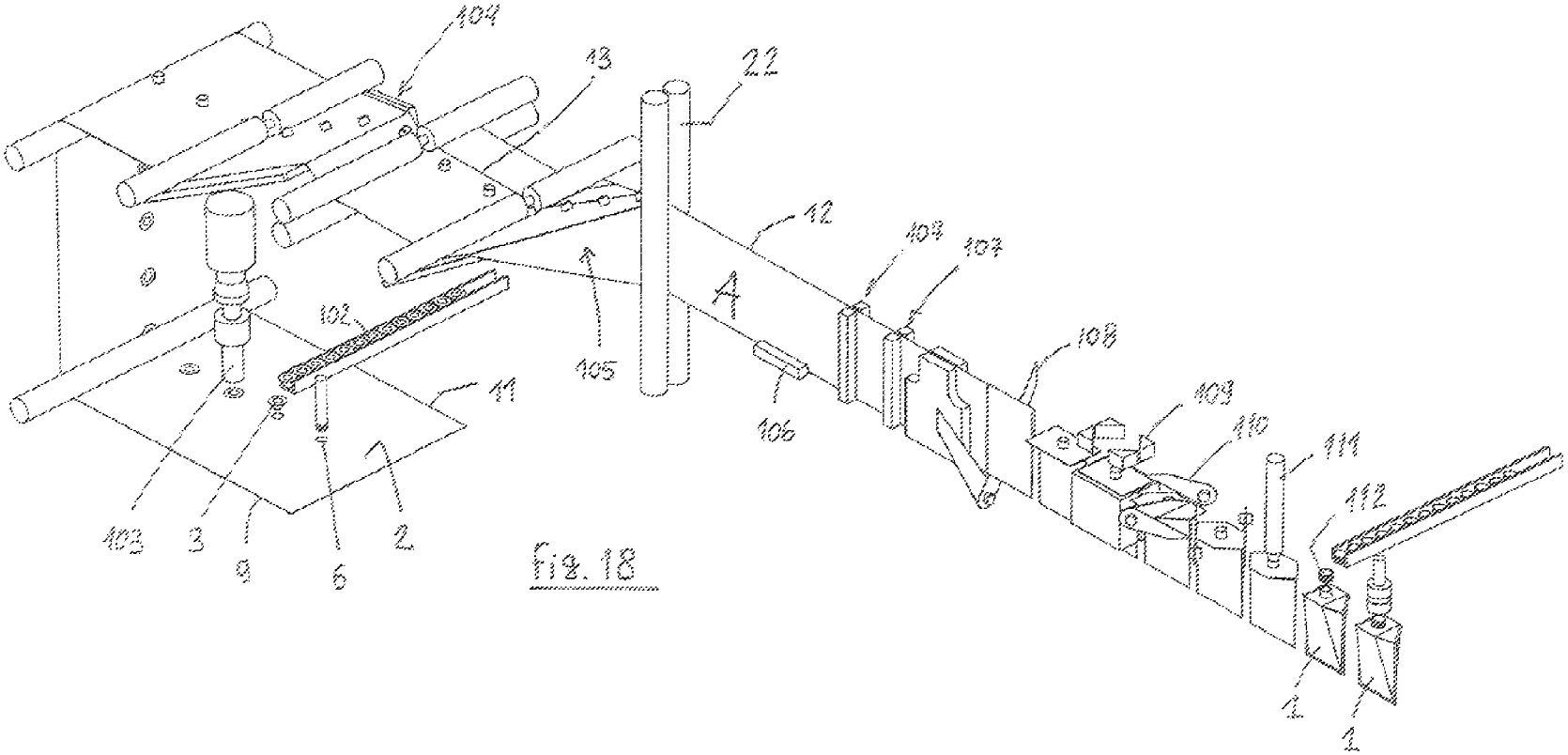
FIG. 18 is a perspective view of a machine for putting into practice the method according to the variant depicted in FIG. 1.

The machine variant depicted in FIG. 18 is suitable for the manufacture of a container 1 such as the one depicted in FIG. 16. Said machine basically differs from the machine of FIG. 12 in that the system for folding the single initial laminar band 2 comprises a folding device 104, suitable for forming a single zigzag fold 38 between the longitudinal fold lines of which there is determined the longitudinal strip of the laminar band 2 intended to form the part of the second side wall 7 which will subsequently abut the back of the upper base 5 of the container being manufactured. In a manner similar to the machine of FIG. 12, this machine comprise a second simple folding device 105 for the laminar band 2, to fold it over itself according to the longitudinal fold 12 (see FIG. 1).

The machine of FIG. 18 thus lacks means for producing a lower base in the container 1, and in its place, downstream from the folding rollers 22, it comprises a set of lower welding jaws 106 suitable for attaching by heat welding the end and superimposed longitudinal edges 9 and 11 of the laminar band 2.

FIGS. 19 to 24 depict alternative variants to the container of FIG. 17, obtainable by the method of the invention without significantly altering the means for putting it into practice or the essence of the invention. It is observed in FIGS. 20 and 21 that one of the side walls 8 is provided with an upper extension 8', extending above the level of the upper base 5 of the container, and that one of the sides of the mentioned upper base 5 is formed by a fold line 36 along which the sheet portion forming it is folded upwardly to form a flap 37, said flap being juxtaposed to the upper extension 8' of the side wall 8 and tightly attached thereto at its contour to form a side neck 38 of the container 10 which can be used as an alternative for its filling. These two variants of the container 10 obtained, similar to that described in patent document WO2007031330 with the exception of the provision of the spout 3 in the upper base 5, can be obtained by slightly modifying the methods depicted in FIGS. 4 and 6, respectively.

Figure 24:
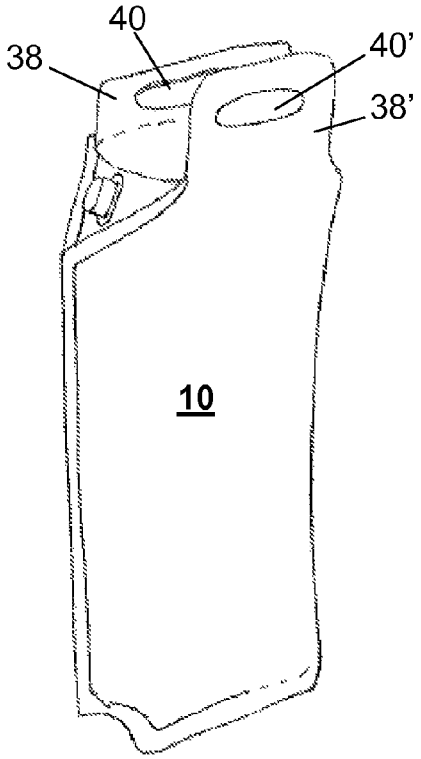
FIG. 24 shows a container obtainable by means of any one of the variants of the method depicted in FIGS. 3 to 7, with the singularity that both the upper base and the sides of the container are extended and are mutually attached.

The container 1 depicted in FIG. 24 incorporates two flaps 38 and 38', similar to those of the previous variants, provided with respective holes 40 and 40' fulfilling the function of a handle.

Figure 22A:
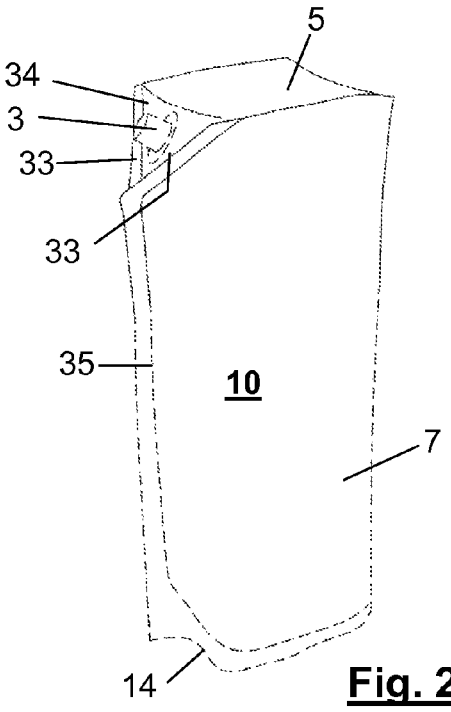
FIGS. 22*a* and 22*b* show a container obtainable by means of the variant of the method depicted in FIG. 3, 5 or 7, the spout being off-centred with respect to the centre of the upper base.
Figure 22B:
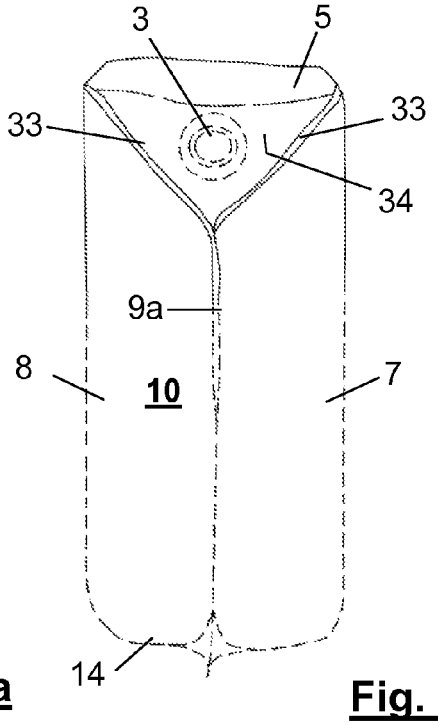
Figure 23A:
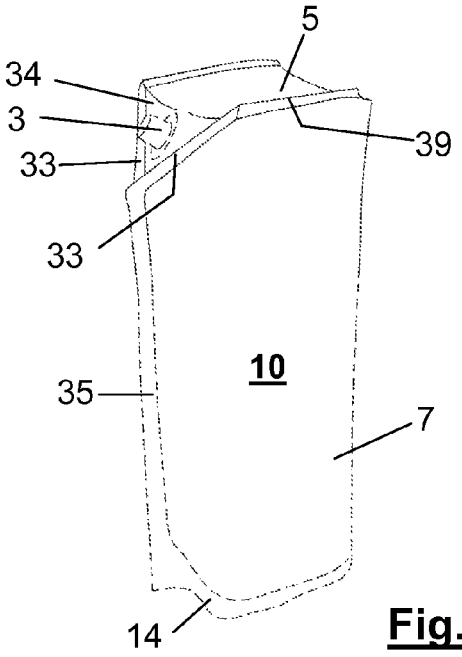
FIGS. 23*a* and 23*b* show a container obtainable, for example, by means of a modified variant of the method depicted in FIG. 3, 4, 5, 6, 7, the spout being off-centred with respect to the centre of the upper base.
Figure 23B:
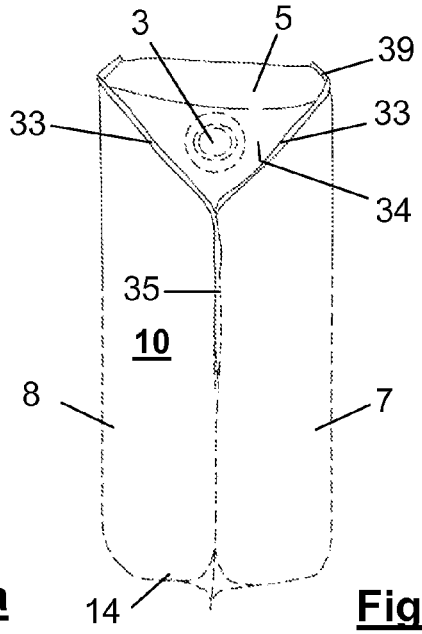

According to the examples of FIGS. 22 and 23, it is envisaged that the spout 3 is arranged in the area of the upper base 5 which determines one of the transition shoulders 34, without this affecting the additional cutting operation which confers to the full container 10 the singular features described above, relative to a higher strength.

Figure 19A:
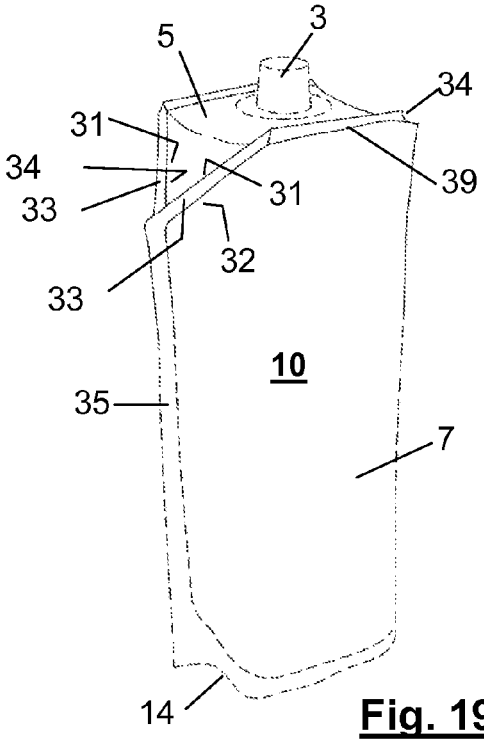
FIGS. 19*a* and 19*b* show a container obtainable by means of the variant of the method depicted in FIG. 3, 4, 5, 6; or 7
Figure 19B:
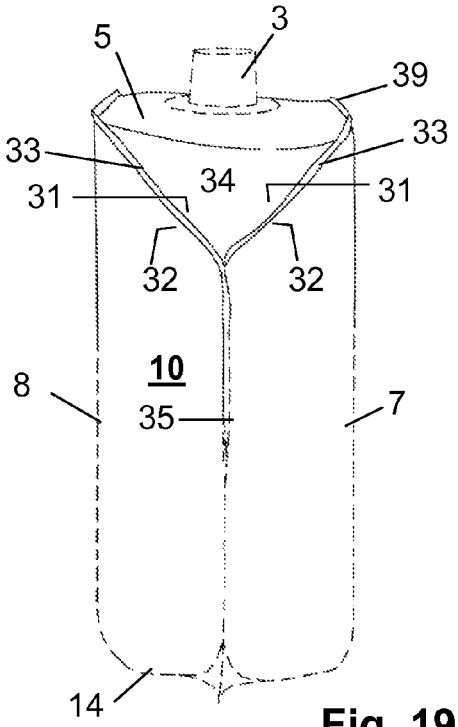
Figure 20A:
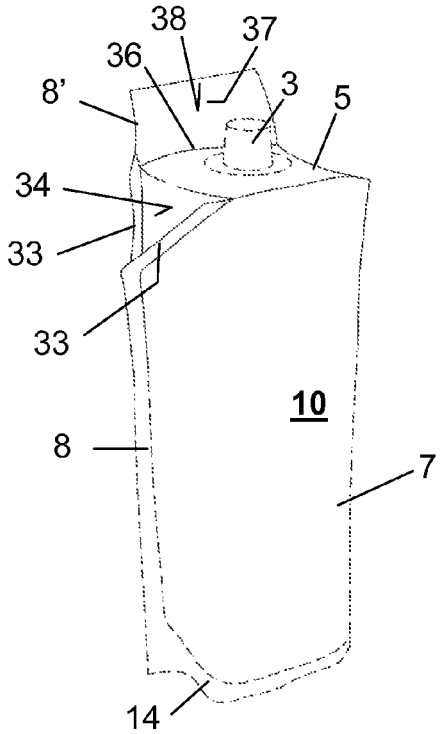
FIGS. 20*a* and 20*b* show a container obtainable, for example, by means of a modified variant of the method depicted in FIG. 3, 4; 5 or 7
Figure 20B:
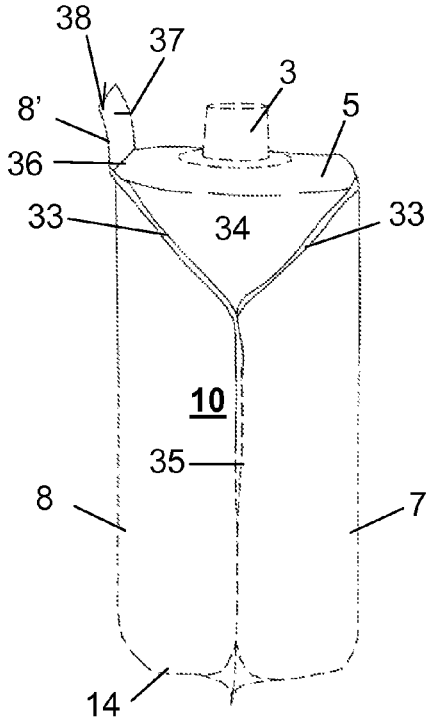
Figure 21A:
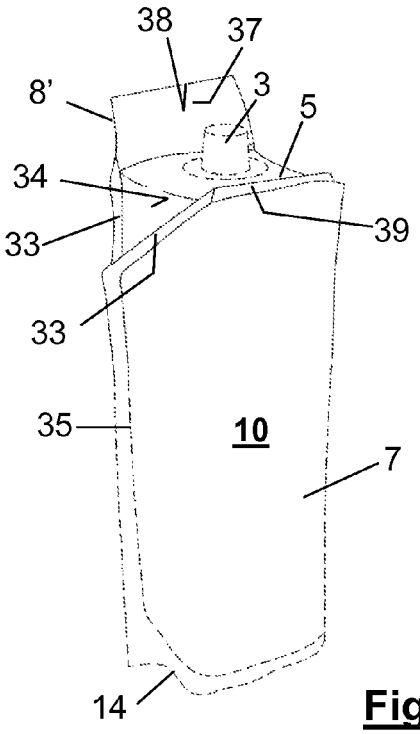
FIGS. 21*a* and 21*b* show a container obtainable, for example, by means of a modified variant of the method depicted in FIG. 3, 4, 5, 6; or 7
Figure 21B:
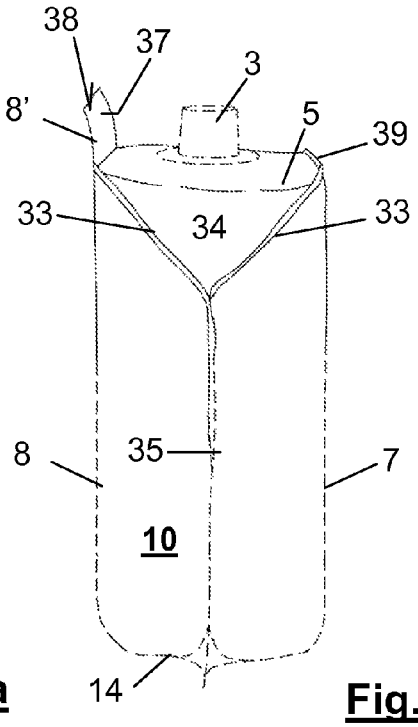

It is pointed out that although the sheet portions forming the upper base 5 and the side walls 7 and 8 of the container are two contiguous portions of one and the same sheet attached without interruption and an attachment by heat welding which would give rise to a respective weld bead (which would occur from the variants of the method depicted by way of example in FIGS. 3, 5 and 7) is not necessary, providing the sheet portion forming the upper base 5 with respective vertical rims 39 and applying them and attaching them by heat welding to the upper edge of the vertical walls 7 and/or 8, all this as illustrated in FIGS. 19 and 21, is envisaged.

The invention claimed is:

1. A method for continuously manufacturing containers made of a flexible material, from a single continuous laminar band made of plastic material heat-weldable on one of the faces thereof, the container being of the type in which there are distinguished, in the normal open position, two facing side walls and at least one upper base, wherein in a production phase, the single initial continuous laminar band is folded over itself along longitudinal fold lines according to a first and a second double zigzag folds and further folded over itself towards its heat-weldable face according to a third 180° fold until its cross-section forms a planar figure comprising the first side wall, along one of the edges of which the upper base of the container is collapsed; and the second side wall, the upper end portion of which is folded over itself downwardly and abuts the back of the collapsed upper base of the container, before the mentioned single continuous laminar band is transversely cut.

2. The method according to claim 1, characterized in that before the production phase, in a first prior operation there is applied on the single initial continuous laminar band a series of spouts for allowing the exit of the product contained inside the containers to be manufactured, equidistant from one another and aligned according to a line parallel to the longitudinal edges of the corresponding band.

3. The method according to claim 2, characterized in that before the application of the spouts, the portion of laminar band intended to be provided with the spouts is provided with a series of holes for communicating the interior of the container to be manufactured with the exterior through the corresponding spouts.

4. The method according to claim 2, characterized in that the alignment of spouts is shifted towards one of the longitudinal edges of the single initial laminar band, and in that the portion of material separating the spouts from a respective longitudinal edge of the mentioned laminar band is sufficient to form in the subsequent production phase half of the upper base and a corresponding side wall of the container.

5. The method according to claim 4, characterized in that the production phase comprises the operations of:

a) folding the laminar band according to a first double zigzag fold, towards its heat-weldable face, over a first and a second longitudinal fold lines, with alternate 180° angles, to form the lower base of the container;

b) folding the laminar band according to a second double zigzag fold, also towards its heat-weldable face and with alternate 180° angles, over a third and a fourth longitudinal fold line, the second side wall of the container being determined between the fourth fold line and the closest longitudinal edge of the laminar band;

c) folding the laminar band over itself according to a third 180° fold towards its heat-weldable face, over a fifth longitudinal fold line, the fourth and the fifth fold lines, which delimit the upper base of the container, each being on one side of the alignment of spouts, such that the inner face of the second longitudinal edge of the laminar band is superimposed and coincident with the inner face of the first longitudinal edge of the laminar band, the first side wall of the container being determined between the fifth fold line and the second fold line;

d) attaching, by welding, the corners of the lower base to the respective facing areas of the first and second side walls, at least partially the facing longitudinal edges of the laminar band, the facing portions of the laminar band along a longitudinal strip coincident with the second fold line, and the first and second side walls along two transverse weld beads separated according to the width of an empty and folded container;

e) transversely cutting the band folded over itself by means of a cut made substantially through the middle of the transverse weld beads, individualizing at least one container from the rest of the laminar band; and f) turning the container portion comprised between the mentioned fourth and fifth fold lines, which determines its upper base, the fourth fold line being separated from the second side wall of the container until adopting a position substantially perpendicular to the body of the container.

6. The method according to the claim 5, characterized in that it comprises the additional operations of attaching, by heat welding, g) the corners of the upper base with the portions of laminar band of the second side wall which abut the underside of the mentioned upper base, and the corners of the latter with the portions of laminar band of the first side wall which face one another under the mentioned upper base in the event that this operation has not been performed in a previous stage; and h) the corners of the upper base with the portions of laminar band of the first side wall which face one another behind the mentioned upper base.

7. The method according to claim 6, characterized in that the portions resulting from the four welding attachments of the two pairs of corners of the upper base with the side walls are subjected to an additional cutting, adhesion, folding or conditioning operation.

8. The method according to claim 7, characterized in that the four welding attachments of the two pairs of corners of the upper base with the side walls have a triangular shape, and in that said attachments are subjected to a cutting operation in the direction of the hypotenuse and providing the upper base of the container being produced and the respective side walls with corresponding bevels.

9. The method according to claim 5, characterized in that in operation a), the first double zigzag fold is made such that the distance separating a first longitudinal edge of the laminar band from the first longitudinal fold line is equal to that separating the latter from the second longitudinal fold line, making said first longitudinal edge of the laminar band be superimposed and coincident with the second longitudinal fold line;

in operation b), the second double zigzag fold is made such that the distance between said third and fourth longitudinal fold lines is substantially equal to that between the first and second longitudinal fold lines; and operation c) is performed such that the distance between the fourth and the fifth longitudinal fold lines is substantially twice the one between the first and the second fold lines, and such that the spouts of the container being formed are preferably arranged in the geometric centre of the quadrangular area forming the upper base of the mentioned container being formed.

10. The method according to claim 4, characterized in that the containers are produced in an inverted position, and in that they are filled through a non sealed portion of the facing longitudinal edges of the laminar band.

11. The method according to claim 1, comprising the step of providing, in the advance direction of the continuous laminar band, a device suitable for making an alignment of holes in a continuous laminar band and for placing a corresponding spout in each of them;

means for folding over itself the single initial laminar band, until its cross-section forms a planar figure comprising a first side wall along one of the edges of which there is collapsed a longitudinal strip of the laminar band comprising the portion of band previously provided with spouts, and a second side wall, the upper end part of which is folded over itself downwardly and abuts the back of the mentioned longitudinal strip of the laminar band, said means for folding over itself the laminar band comprising:

a first folding device for the band to simultaneously form a first double zigzag fold, over a first and a second longitudinal fold line, and a second also zigzag double fold, over a third and a fourth longitudinal fold line; and a second simple folding device for the band to fold the band over itself according to a third 180° fold towards its heat-weldable face, over a fifth longitudinal fold line, the machine further comprising transverse cutting means for the folded single laminar band to separate a container being manufactured from the rest of the folded laminar band; and means for turning the mentioned longitudinal strip of the separated container with respect to the side walls until the cross-section of the container being manufactured adopts a contour with a general "T" shape.

12. The method of claim 11, wherein the distance separating a first longitudinal edge of the laminar band from the first fold line is equal to that separating the latter from the second fold line, making said first longitudinal edge of the laminar band be superimposed and coincident with the second fold line; and that the distance between the third fold line and the closest longitudinal edge of the laminar band is equal to the desired height of a side of the container; and the fourth and the fifth fold lines each are on one side of the holes, such that the inner face of the other longitudinal edge of the laminar band is superimposed and coincident with the inner face of the first longitudinal edge of the laminar band, the machine furthermore comprising downstream from the system for folding the laminar band a set of rollers for flattening said already folded band and for driving it towards the transverse cutting means.

* * * * *